US005123188A

United States Patent [19]

Loda

[11] Patent Number: 5,123,188

[45] Date of Patent: Jun. 23, 1992

[54] KIT FOR A MULTIPART FASTENER HAVING A SPACER WITH AN ADHESIVE LAYER AND A RELEASE LAYER

[76] Inventor: David Loda, 53 Horton Ave., Cheshire, Conn. 06410

[21] Appl. No.: 420,756

[22] Filed: Oct. 12, 1989

[51] Int. Cl.[5] ..... A44C 3/00

[52] U.S. Cl. ..... 40/1.5; 24/114

[58] Field of Search ..... 40/1, 1.5, 1.6, 329, 40/662, 663, 667-669; 63/20, 12, 13; 24/706.5, 103, 114, 107

[56] References Cited

U.S. PATENT DOCUMENTS

| | | | |
|---|---|---|---|
| 2,730,824 | 1/1956 | Cohen | 40/1.5 |
| 2,975,538 | 3/1961 | Murfin | 40/1.5 |
| 3,430,829 | 3/1969 | Wilson et al. | 40/1.5 |
| 3,732,599 | 5/1973 | Morissette | 24/103 |
| 4,691,457 | 9/1987 | Peroni | 40/1.5 |
| 4,771,613 | 9/1988 | Grier et al. | 24/107 |

*Primary Examiner*—Joseph Falk
*Assistant Examiner*—James M. Gardner
*Attorney, Agent, or Firm*—Evelyn M. Sommer

[57] ABSTRACT

An improved support assembly for mounting a ribbon, medal, or other indicia on an outside surface of the fabric layer of a uniform includes a spacer having a central hole for receiving the spike of the ribbon holding structure therethrough, and an adhesive layer on one surface thereof which is adhered to the corresponding fastener for the spike to form an integral unit therewith. The spacer having a thickness in relation to the length of the spike sufficient to hold the ribbon against the fabric layer and prevent the ribbon, medal, or other indicia from sagging.

6 Claims, 1 Drawing Sheet

KIT FOR A MULTIPART FASTENER HAVING A SPACER WITH AN ADHESIVE LAYER AND A RELEASE LAYER

FIELD OF THE INVENTION

This invention relates to an improved support assembly such as for ribbons, medals, and other insignias worn on a uniform.

BACKGROUND ART

Ribbons, honorary medals, and other insignias are typically affixed to the lapel or breast of a uniform using one or more ribbon supports. The ribbon, medal, or insignia typically has a bar-shaped or otherwise generally flat holding or underlying structure, and the ribbon support assembly typically consists of one or a spaced-apart pair of retainer spikes projecting rearwardly from the back surface of the holding structure which are intended to penetrate through the fabric of the uniform and have their points retained in brass fasteners or clip holders positioned on the inside surface of the uniform. The ribbon is thus retained on the outside surface of the uniform without the support assembly being visible.

However, such ribbon support assemblies have the disadvantage that the ribbon, medal, or indicia may often sag or appear to be loose, particularly if it has a substantial weight and/or the length of the spike(s) is long in relation to the thickness of the uniform fabric. Plastic shims or spacers are available from military clothing and other stores, but are inconvenient to handle and assemble on the uniform.

SUMMARY OF THE INVENTION

In order to overcome the disadvantages of the prior art, a principal object of the invention is to provide an improved ribbon support assembly that eliminates sagging or a loose appearance of ribbons mounted on the fabric of a uniform.

In a support assembly such as for mounting a ribbon, medal, or other indicia on an outside surface of a fabric layer, of the type including a holding structure having a decorative portion on a forward surface thereof and one or more rearwardly projecting retainer spikes of a given length fixed to a back surface thereof for penetrating through the fabric layer, and fasteners for retaining respective ends of the spikes on an inside surface of the fabric layer, the invention comprises the improvement of a spacer having a central hole for receiving a spike therethrough, and an adhesive layer on one surface thereof which is adhered to the corresponding fastener to form an integral unit therewith, said spacer having a thickness in relation to the length of the spike sufficient to suitably abut against the fabric layer and prevent the ribbon, medal, or other indicia from sagging thereon when the end of the spike is retained by the fastener on the inside surface of the fabric layer.

Other objects, features, and advantages of the present invention will become apparent from the following detailed description of the invention considered in conjunction with the drawings, as follows:

DESCRIPTION OF THE PREFERRED EMBODIMENT

Figure 1:
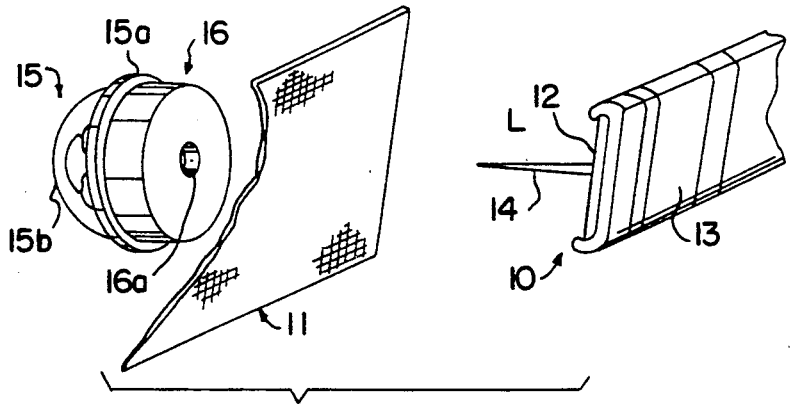
FIG. 1 is a perspective view of an improved ribbon support assembly in accordance with the invention.

Referring to the drawings, a ribbon support assembly for a ribbon, medal, or other insignia 10 to be mounted on the outside surface of a fabric layer 11, e.g., of a uniform, includes a holding structure 12 for the ribbon, etc., having a decorative portion 13, such as a cloth ribbon, on a forward surface thereof and a rearwardly projecting retainer spike 14 of a given length L fixed to the back surface of the holding structure 12 for penetrating through the fabric layer 11, and a corresponding fastener 15 for retaining the end of the spike 14 on the inside surface of the fabric layer 11. The ribbon 10 is mounted on the outside surface of the fabric layer 11 with the spike 14 pushed through the fabric layer and retained on the inside surface by the fastener 15.

The holding structure 12 is typically in the form of a flat, brass bar with a cloth ribbon mounted on its forward surface. The fastener 15 is typically made of brass and has a forward face plate **15*a* with a central hole for receiving the end of the spike therein and a pair of clip arms or wings which are squeezed to allow insertion of the spike end then released to retain the spike end by the force of a spring. The spike typically has a length L of about 0.25 inch. The ribbon 10** may be of the type that has one spike or a spaced-apart pair of spikes, and it may also be in the form of a medal or a metal insignia, such as Air Force wings and the like.

In accordance with the invention, the improved ribbon support assembly includes a spacer 16 having a central hole **16*a* for receiving the spike therethrough, and an adhesive layer 16*b* on one surface thereof which is adhered to the face plate 15*a* of the fastener. Affixing the spacer 16 to the fastener incorporates it as an integral unit which eliminates having to handle it as a separate component and ensures that it is always properly positioned and aligned in the assembly. When the end of the spike 14 is retained by the fastener, the spacer 16 suitably presses the fabric layer 11 of the uniform against the back surface of the holding structure 12. The spacer 16 has a thickness W in relation to the length L of the spike 14** sufficient to prevent the ribbon, medal, or other indicia from sagging. For example, a thickness W of about 0.125 ($\frac{1}{8}$) inch is found to work well with standard military uniforms of average to lightweight thickness.

Figure 2:
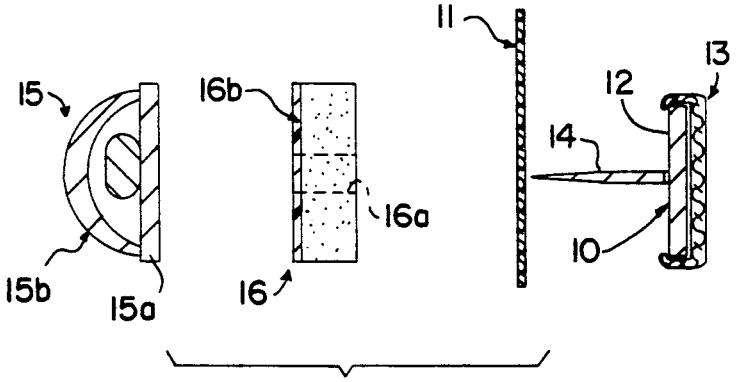
FIG. 2 is a side schematic view of the improved ribbon support assembly of the invention.
Figure 3A:
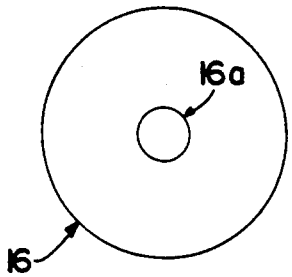
FIGS. 3A and 3B are plan and side views of the spacer used in the improved ribbon support assembly.
Figure 3B:
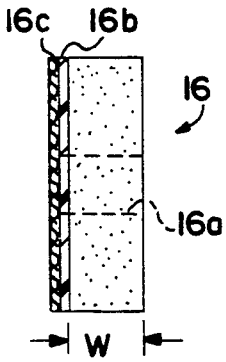

In the preferred embodiment, the ribbon spacer 16 is an adhesive-backed foam rubber washer made of Rubatex TM polymer neoprene EPT/SBR#R-443-N, supplied by Nerac Company in Windsor, Connecticut. The rubber washer is made in a neutral grey color so that it can be used with all types of uniforms without showing through the fabric. It is manufactured by stamping out of an $\frac{1}{8}$ inch thick sheet using a "clicker" type die. The preferred washer is 7/16 inch in outside diameter, and has a central hole of about $\frac{1}{8}$ inch diameter for clearance of the spike therethrough. The outside diameter of the preferred washer is selected to be slightly smaller than the diameter of the standard fastener which typically may be $\frac{1}{2}$ inch for the fastener 15 as shown in FIG. 2. The softness of the foam rubber allows the washer to conform to the surface of the fastener face plate **15*a* and to the shirt fabric layer 11. It also allows for varying lengths between the fastener face and the holding structure and varying thicknesses of the fabric layer. For very thick uniforms, such as a heavyweight jacket, the ribbon can be fastened to a fastener without the rubber washer, in order to avoid deformation over a long period of time. The adhesive layer is made of a strong water-proof adhesive to keep the washer affixed to the fastener even through high moisture conditions, such as going through a washing machine. As shown in FIG. 3B, the improved ribbon spacer is supplied with a release tape or backing layer 16c** which is removed when the spacer is to be affixed to the fastener.

The improved support assembly can be used for mounting other objects, such as a tie or other clothing accessories. All modifications and variations thereof are intended to be included within the spirit and scope of the invention, as defined in the following claims.

I claim:

1. A kit for a support assembly for mounting a ribbon, medal or other indicia on an outside surface of a fabric layer, such as a shirt or uniform including a mountable ribbon, medal or like decorative indicia; a holding structure having said decorative indicia on a forward surface thereof; one or more rearwardly projecting retainer spikes of a given length fixed to a back surface thereof for penetrating through the fabric layer; one or more fasteners for retaining respective ends of the spike on an inside surface of the fabric layer, at least one of the fasteners having a forward surface facing in a forward direction; a spacer having a central hole for receiving a spike therethrough; an adhesive layer on the rear surface thereof adapted for being adhered to the forward surface of the corresponding fastener to form an integral unit therewith; and a release tape or layer applied on said adhesive layer and being removable therefrom for adhering said spacer to the fastener, said spacer having a thickness in relation to the length of the spike sufficient to suitably abut against the fabric layer and prevent the ribbon, medal, or other indicia from sagging thereon when the end of the spike is retained by the fastener on the inside surface of the fabric layer.

2. A kit for a support assembly according to claim 1, wherein said spacer is formed as a round elastic washer having a central hole for clearance of the spike therethrough.

3. A kit for a support assembly according to claim 2, wherein said spacer has a thickness of about ⅛ inch, an outside diameter of about 7/16 inch, and a central hole diameter of about ⅛ inch for accomodating standard dimensions of the fastener and spike.

4. A kit for a support assembly according to claim 1, wherein said spacer has an outside diameter selected to be slightly smaller than the diameter of the fastener.

5. A kit for a support assembly according to claim 1, wherein said adhesive layer of the spacer is made of a strong water-proof adhesive to keep the washer affixed to the fastener even through high moisture conditions.

6. A kit for a support assembly according to claim 1, wherein said spacer is made of foam rubber.

* * * * *